US006223919B1

(12) United States Patent
Kuehn

(10) Patent No.: US 6,223,919 B1
(45) Date of Patent: May 1, 2001

(54) CLOSURE FOR PLASTIC TUBE

(76) Inventor: Hans Kuehn, Schmidbachstrasse 9, 76467 Bietigheim (DE)

( * ) Notice: Subject to any disclaimer, the term of this patent is extended or adjusted under 35 U.S.C. 154(b) by 0 days.

(21) Appl. No.: 09/180,012

(22) PCT Filed: Apr. 30, 1997

(86) PCT No.: PCT/EP97/02223

§ 371 Date: Oct. 29, 1998

§ 102(e) Date: Oct. 29, 1998

(87) PCT Pub. No.: WO97/41041

PCT Pub. Date: Nov. 6, 1997

(30) Foreign Application Priority Data

Apr. 30, 1996 (DE) ..... 196 17 350

(51) Int. Cl.[7] ..... B65D 39/00

(52) U.S. Cl. ..... 215/252; 215/44; 215/330; 222/541.5; 222/551; 222/562

(58) Field of Search ..... 215/252, 330, 215/331, 44; 222/541.5, 551, 562

(56) References Cited

U.S. PATENT DOCUMENTS

| | | | | |
|---|---|---|---|---|
| 2,684,168 | * | 7/1954 | McGinnis et al. | 215/330 |
| 4,415,094 | * | 11/1983 | Bavnsfelt | 215/252 |
| 4,461,391 | * | 7/1984 | Davis | 215/252 |
| 4,505,401 | * | 3/1985 | Berglund | 215/252 |
| 4,541,536 | * | 9/1985 | Davis et al. | 215/252 |
| 4,763,804 | | 8/1988 | O'Connell . | |
| 4,930,647 | | 6/1990 | Dutt et al. . | |
| 5,111,967 | | 5/1992 | Schreiber . | |
| 5,273,173 | * | 12/1993 | Debetencourt | 215/252 |
| 5,487,481 | * | 1/1996 | Sander et al. | 215/252 |
| 5,678,714 | * | 10/1997 | Guglielmini | 215/252 |

FOREIGN PATENT DOCUMENTS

| | | |
|---|---|---|
| 83 01 345 U | 9/1983 | (DE) . |
| 37 42 692 A1 | 6/1988 | (DE) . |
| 92 12 753 | 11/1992 | (DE) . |
| 0 080 846 | 6/1983 | (EP) . |
| 0 219 946 | 4/1987 | (EP) . |
| 2 542 706 | 9/1984 | (FR) . |
| 1161025 | 8/1969 | (GB) . |
| 1 269 723 | 4/1972 | (GB) . |
| 2 140 787 | 12/1984 | (GB) . |

* cited by examiner

*Primary Examiner*—Stephen K. Cronin
(74) *Attorney, Agent, or Firm*—Renner, Otto, Boisselle & Sklar LLP

(57) ABSTRACT

The present invention relates to plastic tubes, and in particular to those which have a locking mechanism which comprises a locking cam and a latching cutout and which permits reliable latching of the tube cap to the tube. The invention also relates to plastic tubes which have a sealing strip which is constructed on the tube cap and, in accordance with the invention, can assume specific preferred embodiments.

10 Claims, 8 Drawing Sheets

CLOSURE FOR PLASTIC TUBE

1. TECHNICAL FIELD

The present invention relates to a plastic tube, comprising a tube body and a tube cap, for flowable or free-flowing or pasty components. In particular, the plastic tube according to the invention has an indicating strip (guarantee closure) and a cap locking mechanism which latches the tube cap to the tube body when the tube cap is screwed on to the tube body.

2. PRIOR ART

Tube cap locking mechanisms were not necessary in the tubes used earlier. These already known tubes mostly comprise a tube body, produced from aluminium, and a tube cap, produced from plastic, which were provided in each case with an industrial screw thread of complementary construction. An industrial thread is understood below as a thread for a plastic tube cap which was not positively disengaged, as is customary in the case of tube caps (by contrast with, for example, bottle caps).

An adequately reliable fastening of the tube cap on the tube body was achieved by virtue of the fact that the cooperating screw threads were constructed with as fine a pitch as possible, so that owing to the correspondingly small thread pitch and to the aluminium/plastic material combination, the cap held on the tube body sufficiently firmly when it was screwed on with adequate tightness. This prevented inadvertent detachment or else only loosening of the tube cap from the tube body.

However, tubes consisting of aluminium (or another metal) have recently been increasingly fading into the background; they are more and more being replaced by tubes consisting entirely of plastic. Furthermore, requirements placed on tubes with regard to the screw thread have recently been changed: repeated rotation of the tube cap which is required to achieve the sealing effect, in both meanings, of the tube closure in the case of fine threads is nowadays felt to be an imposition. Moreover, in the case of a fine thread the screw thread of the tube cap must be brought very exactly into position with regard to the screw thread of the tube, in order to permit the tube cap to be screwed on without tilting.

For these reasons, increased use is currently being made of coarse threads with a high thread pitch which, on the one hand, permits the tube cap to be screwed on with a few turns and, on the other hand, render it unnecessary to position the screw thread of the tube cap and of the tube body accurately with respect to one another. These recent tube caps have the disadvantage, however, that the tube cap easily becomes detached or else can merely become loosened, as a result of which the tube components can escape from the tube and/or an adequate seal is no longer achieved.

A further problem of previously known tubes occurs in connection with the current environmental requirements. Whereas previously each individual tube was also provided with an enveloping package in the form of a small cardboard box, this additional package is dispensed with nowadays in order to avoid refuse. The enveloping packages used previously had the advantage that it was easy to seal the package in a simple way using a sticker which was destroyed when the package was opened for the first time. It was possible in this way for the customer to establish without difficulty that he was acquiring a tube which was acceptable because it was unopened. This simple measure of ensuring quality is no longer possible with the elimination of the enveloping packages.

As an alternative, a type of adhesive seal which was stuck over the joint between the tube cap and tube body was therefore taken into consideration for tubes offered without enveloping packaging. When the tube cap was turned for the first time, the adhesive seal was broken, and so the customer could see whether the tube had already been opened or not.

A disadvantage of this sealing technique resides in the possibility that after the tube has been opened for the first time a new seal is stuck on to the joint, thus giving the impression of an intact tube. A further disadvantage resides in the fact that when checking the integrity of the seal it is necessary to keep turning the tube until the seal can be seen—an activity which can be very time consuming and laborious.

Also known are other sealing techniques, which have a pin which is arranged on the cap shoulder and is connected to the cap. Upon first-time opening by raising the cap, this pin breaks and therefore indicates that the tube is not intact. Also known are seals which have a transverse tab which must be torn off before opening the tube.

These seals likewise have the disadvantage that they can be seen only from one side of the tube, with the result that the tube must firstly be turned, as in the case of the seal previously described. Furthermore, tearing off the transverse tab produces refuse which must additionally be disposed of, and both the pin and the transverse tab can be produced only expensively in term of production engineering.

The printed publication DE 83 01 345 U1 describes a tube for sensitive filled products, which comprises a tube body provided with a screw thread, and tube cap provided with a complementary screw thread. Until first use is made, the previously known tube also has an additional sealing closure which is arranged in the interior of the cap lid in such a way that it seals the outlet end of the tube body GB 1 269 723 has disclosed a tube with a plastic cap and a metal body. The cap from this printed publication is provided with an additional collar part which is connected to the tube cap by means of connecting labels.

With regard to the above prior art, the present invention is therefore based on the technical problem of creating a plastic tube which comprises a tube cap and tube body and, on the one hand, permits the tube cap to be fastened on the tube body in a way which ensures sealing and holds even in the case of screw threads with a large thread pitch and which, on the other hand, has a seal which is easy to see and operates reliably even with small plastic tubes.

3. SUMMARY OF THE INVENTION

The present invention solves the above problem by means of a plastic tube which, in accordance with patent claim 1, has a locking mechanism comprising a locking cam and a latching cutout.

Furthermore, the present invention solves the above problem by means of a plastic tube which, in accordance with patent claim 17, has a sealing strip constructed on the tube cap.

The present invention comprises elements which are complementary both with regard to the sealing strip and with regard to the locking mechanism, and which are arranged in each case on the tube body and the tube cap. Consequently, the aim of the invention is not only to protect the respective combination of tube cap and tube body, but also to protect the respective tube cap and tube body in themselves.

In accordance with the present invention, in addition to the conventional screw thread the plastic tube according to the invention is provided with a tube locking mechanism which comprises at least one locking cam and a cutout of complementary construction which receives the locking cam. The locking of the tube is achieved with the aid of the locking mechanism according to the invention by virtue of the fact that the tube cap is mounted on the tube body and then screwed on as far as an end position in which the locking cam jumps elastically into the cutout and latches therein.

In addition to the locking cam, the tube cap advantageously also has a positive disengaging step. This is advantageously arranged close against the locking cams in a fashion displaced towards the top side of the tube cap, and has the effect that when being positively disengaged the locking cams are scarcely damaged. Specifically, when being positively disengaged the positive disengaging step causes preliminary straining of the tube cap, which largely prevents the deformation of the locking cams. The inventor of the present invention has carried out tests and found in the process that, given a tube cap which is identical per se, the positive disengaging step permits substantially improved latching of the tube cap to the tube body.

In accordance with an advantageous embodiment, the tube cap is constructed as a so-called upright cap with an essentially cylindrical shape, whose diameter corresponds approximately to the largest diameter of the main tube body. For such a tube cap, the screw thread advantageously covers only approximately one third of the cap inner wall, the at least one locking cam being arranged on the remaining part of the cap inner wall. This ensures that the tube cap can be screwed on to the tube body without difficulty, and that the tube locking elements do not interact until the tube cap has reached its end position in the screwed-on state.

In accordance with a further advantageous embodiment of the present invention, the at least one locking cam is constructed in the shape of a diamond or lens. Such shaping has proved to be particularly advantageous from two points of view; firstly, it is easy to realize in terms of production engineering, since, in order to produce the tube caps, use is made in a conventional way of injection moulding methods whose moulds can easily be provided with the appropriate shaping. On the other hand, lens-shaped or diamond-shaped locking cams are preferred with regard to their locking function, since the locking cam can easily be brought into the corresponding recess and be guided out again, satisfactory fixing being ensured nevertheless.

A particularly advantageous embodiment of the invention consists in constructing the cutout provided in a complementary fashion to the locking cams as a groove running around the tube shoulder. The advantage of this embodiment consists in that there is no need to position the at least one locking cam in the tube cap relative to the screw thread; it jumps into the cutout constructed as a groove when the corresponding axial position of the tube cap in relation to the tube body is reached as a consequence of the screwing movement.

In accordance with a further advantageous embodiment, six locking cams are provided which are arranged symmetrically on the inside circumference of the tube cap; this has proved to be particularly advantageous with regard to reliable locking.

In accordance with another embodiment of the locking cam, the latter is constructed as a web extending over the inside circumference of the tube cap. This embodiment permits optimum locking of the tube cap in a way which is easy to achieve in terms of production engineering.

In accordance with a further advantageous embodiment of the present invention, the tube cap additionally has a sealing ring which is arranged on the cap base and seals the outlet opening of the tube upon latching of the tube cap.

Further preferred embodiments of the present invention relate to the inventive sealing strip. Accordingly, in addition to the connecting webs, driving elements are also provided between the tube cap and the sealing strip. On the one hand, these driving elements permit the use of particularly thin (and therefore easy to tear) connecting webs, and on the other hand they permit the cap to be securely and reliably screwed on for the first time together with the sealing strip, particularly even onto very small tubes. If the driving elements (either those on the cap or those on the guarantee strip) are provided, fitted with a run-up slope, on the side which cooperates with the respective complementary driving element upon the first unscrewing, the circumferential sides of the sealing strip and the tube cap can be fitted with a multiplicity of driving elements, and this permits screwing on to be particularly secure.

4. BRIEF DESCRIPTION OF THE DRAWING

The following contains a detailed description of currently preferred embodiments of the present invention, reference being made to the drawing, in which.

Figure 6A:
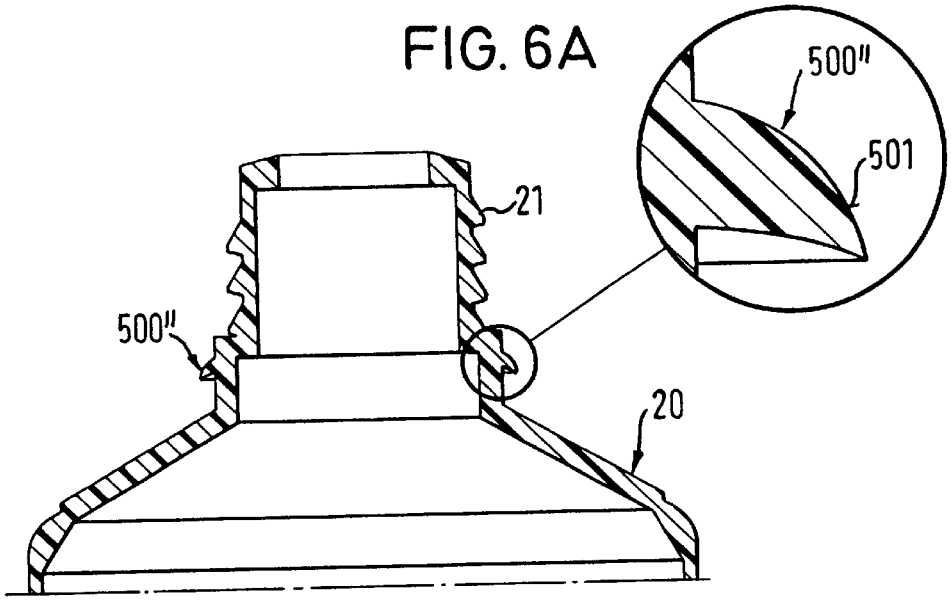
Figure 7:
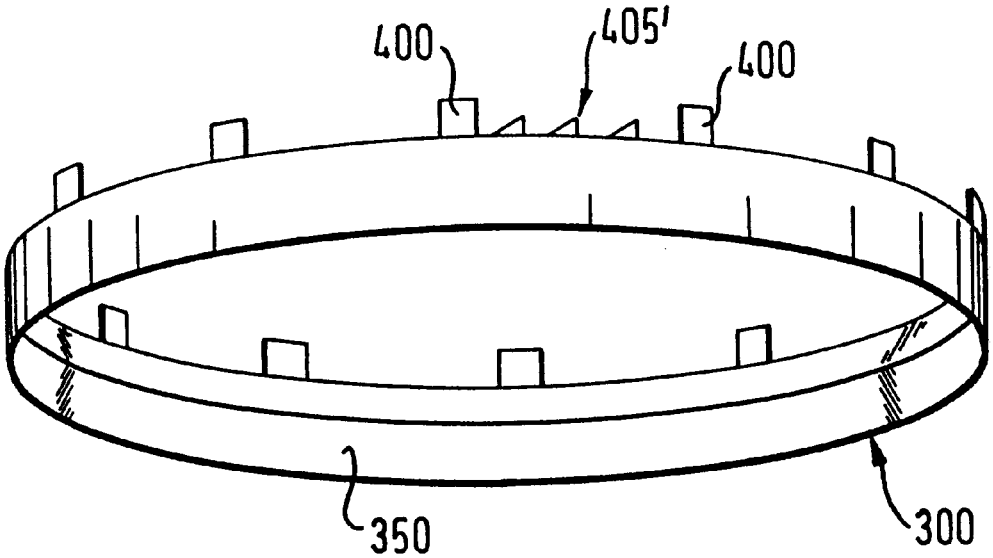
Figure 8:
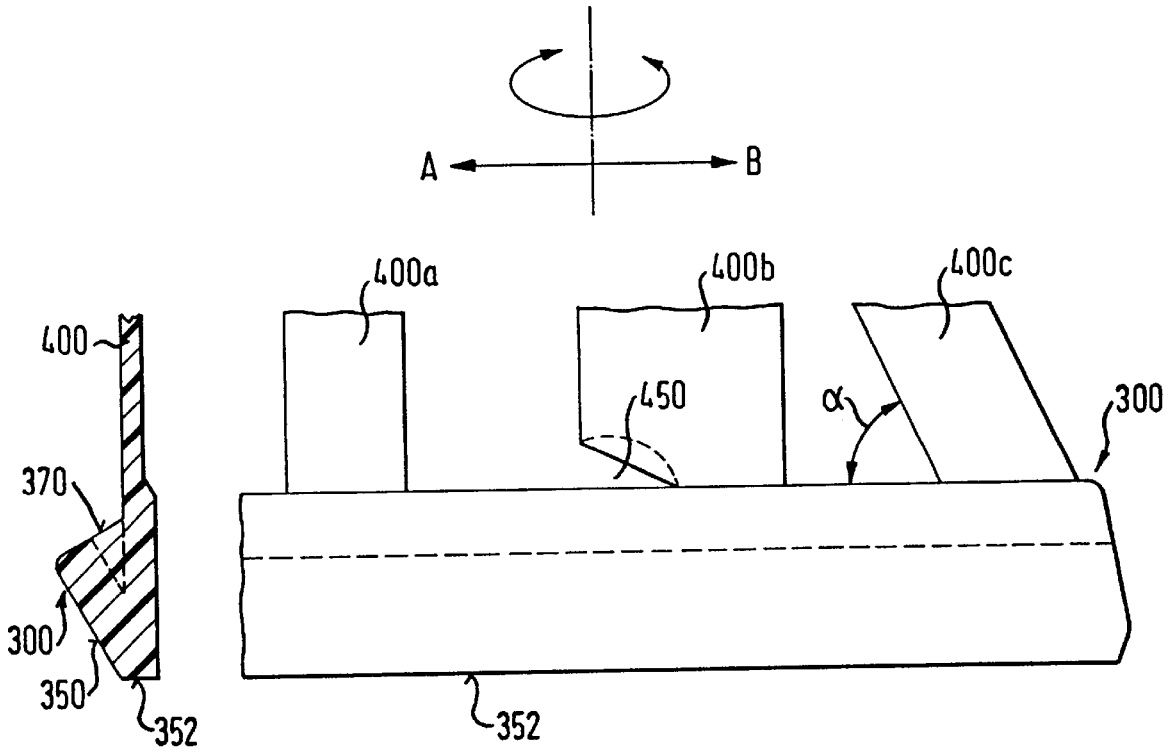
Figure 9:
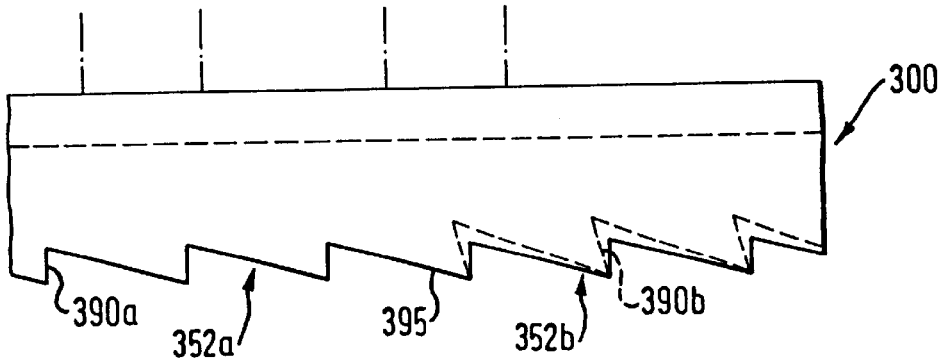
Figure 10:
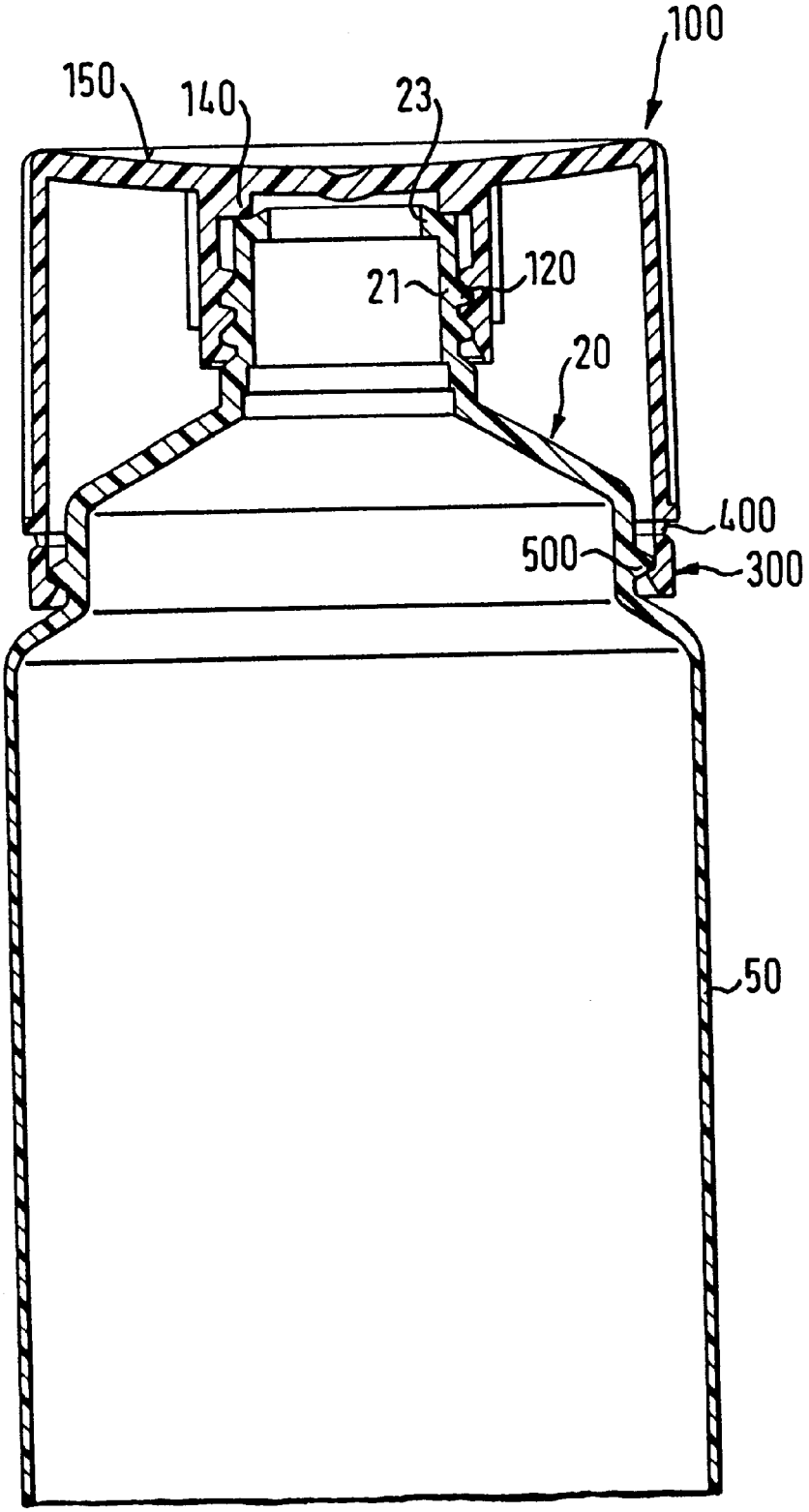

FIGS. 6A,B,C show a further embodiment of a plastic tube according to the invention and of a tube cap which has both a sealing strip according to the invention and a tube locking mechanism according to the invention;

FIG. 7 shows a perspective representation of a preferred embodiment of the sealing strip according to the invention;

FIG. 8 a diagrammatic representation of various inventive tear-off webs of a sealing strip;

FIG. 9 shows a diagrammatic representation of two preferred embodiments of the lower sealing strip tooth system; and FIG. 10 shows an inventive plastic tube in accordance with a further preferred embodiment of the present invention.

Mutually corresponding elements are provided in each case with the same reference numerals in the following preferred embodiments of the present invention.

Figure 1:
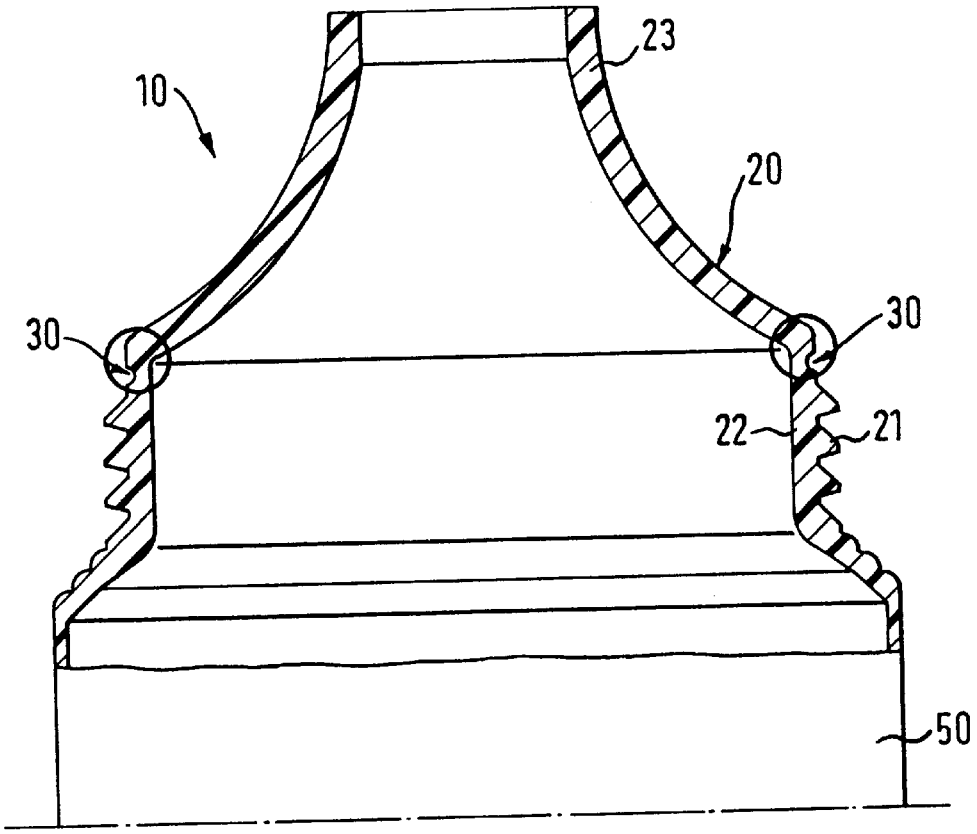
FIG. 1 shows a sectional view of a tube body according to the invention, which comprises a main tube body and a tube shoulder.

FIG. 1 represents a tube body 10 of an inventive tube in accordance with a first preferred embodiment, in a partial sectional view. The tube comprises a main tube body 50 and a tube shoulder 20. The tube body 10 can be produced by using various methods known in the prior art. The tube body advantageously consists of plastic which is given the desired shape by using injection moulding methods. Suitable materials for this are thermoplastics such as polyethylene (PE), polyethylene terephthalate (PET), polypropylene (PP), polyamide (PA), ethylene vinyl alcohol (EVOH) or other plastics. Located in the main tube body 50 is the product respectively to be stored, which is preferably of pasty consistency. However, it is also conceivable to store free-flowing substances (such as fine granules, for example) or flowable substances (such as viscous liquids).

The tube shoulder 20 preferably comprises a threaded part 21, an essentially cylindrical middle part 22 and a nozzle-shaped end part 23 from which the component in the tube emerges. However, other designs of the tube shoulder 20 are also conceivable.

The threaded part 21 is preferably a 3-turn coarse screw thread with a thread pitch of 6 to 12 mm. The essentially cylindrical middle part 22 is constructed on the threaded part 21 in a directly adjoining fashion. The cylindrical middle part includes the latching cutout 30, which is to be described in yet more detail in conjunction with FIG. 2, and can consist of a laminate, as represented in FIG. 1.

Figure 2:
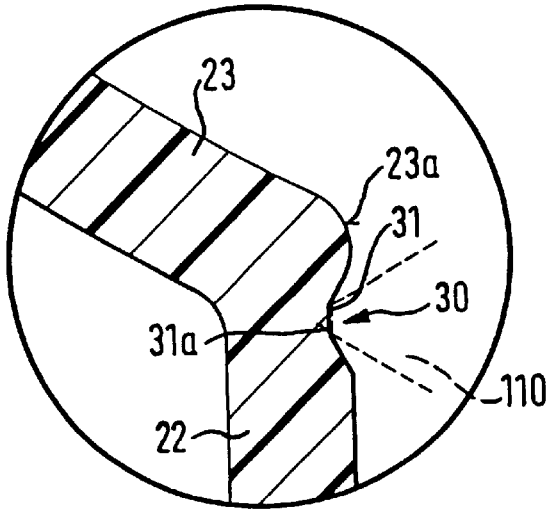
FIG. 2 shows a detailed view of FIG. 1 showing the latching cutout according to the invention.

FIG. 2 (which represents a detailed view of FIG. 1) shows the locking cutout 30 according to the invention. In accordance with the advantageous embodiment represented in FIG. 2, the locking cutout 30 comprises a groove 31 which runs around the tube middle part 22 on the circumferential side, and whose underside is constructed as a flat bed 31*a* which has a diameter of approximately 0.25 mm. When the inventive latching cam 110, which is still to be described in detail in conjunction with FIG. 3, approaches its end position in the screwed-on state, it latches in this groove 31. In this arrangement, the locking cam 110 (represented by dashes in FIG. 2) slides over a knee 23*a*, of circular or bead-like construction, of the end part 23, which preferably has a radius of 0.5 mm. After the cam has overcome the knee 23*a*, it jumps into the groove 31 and is seated on the bed 31*a*. This prevents undesired detachment of the cap, since the cam encounters the—elastic resistance of the knee 23*a*, which can be overcome only by a specific torque.

As an alternative to the circumferential groove 31, the cutout 30 can also be bounded on the circumferential side in accordance with the shape of the locking cam. However, this embodiment is not optimum, since defined positioning of the locking cam is required in relation to the cutout before the screwing on, in order to ensure that in its end position the cam actually does reach the cutout.

Figure 3:
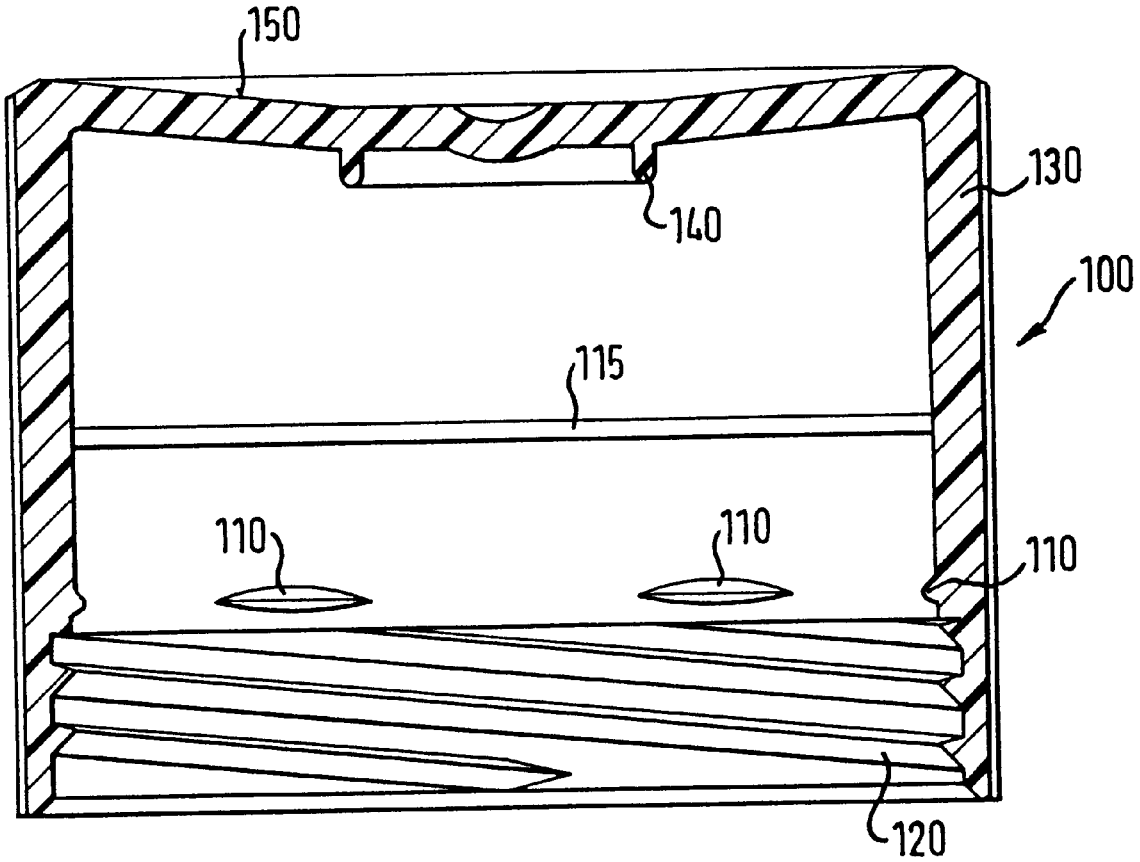
FIG. 3 shows a sectional view of a preferred embodiment of the tube cap according to the invention.

FIG. 3 represents an embodiment of the tube cap 100 according to the invention. As may be seen from the figure, this tube cap 100 is preferably constructed as an upright cap 100 which permits the tube to be set up on its head, the top side 150 serving as tube standing surface. A screw thread 120 constructed in a complementary fashion with respect to the screw thread of the tube shoulder is provided in the interior of the tube cap 100, in the lower region. As is clearly to be seen from the representation, this is preferably a three-turn thread. The remaining part 130 of the tube cap is dimensioned such that it can receive the cylindrical middle part 22 and the nozzle-shaped end part 23 of the tube shoulder 20.

In accordance with a further advantageous embodiment, the tube cap 100 has a sealing ring 140 which is aligned concentrically with the middle point of the base part 150 of the cap 100. The diameter of the sealing ring is preferably designed in such a way that, with the cap screwed on, the ring is seated on the nozzle-shaped end part 23 of the tube shoulder 20, in order to seal off the latter. This is important, in particular, whenever the tube stores components which are not to come into contact with the environment when the tube is sealed, for example in order to prevent the escape of aroma or solvents.

Also to be seen in FIG. 3 is the tube locking mechanism of the tube cap 100, which comprises the at least one locking cam 110 according to the invention. In accordance with FIG. 3, six locking cams, which have the shape of a lens or diamond, are provided in the preferred embodiment. Such shaping has two types of advantages: firstly, it is easy to manufacture it in terms of production engineering, since the appropriate injection moulds are easy to construct accordingly. Secondly, locking cams constructed in such a way permit easy sliding into the corresponding locking cutout 30, a firm seat simultaneously being ensured. The locking cams 110 (for example, two or more) are distributed symmetrically about the inner circumference of the cap 100 in the tube cap represented in FIG. 3.

In accordance with a further alternative (not represented in FIG. 3) it is also possible to provide a multiplicity of locking cams 110, the result in the limiting case being a locking web running along the cap inner wall. Such a web is also easy to manufacture in terms of production engineering, and has the advantage of particularly firm seating of the cap. Of course, when constructing the locking cam as a web it is also necessary for the cutout 30 to be constructed as a groove 31 running around the tube shoulder.

As is further to be gathered from FIG. 3, the locking cams 110 are located close by the threaded part 120 of the tube cap 100; they are both located in the lower third of the tube cap. This has the advantage that the axial displacement torque started by the thread 120 is transmitted as directly as possible onto the locking cams, in order to draw them effectively into the complementary cutout 30 in the tube shoulder 20. When the locking came are arranged approximately in the top third of the tube cap 100, the elasticity of the tube cap material and the deformation thereby occurring can lead to failure of the locking cam 110 to jump into the correspondingly provided cutout in a self-closed fashion.

Figure 4A:
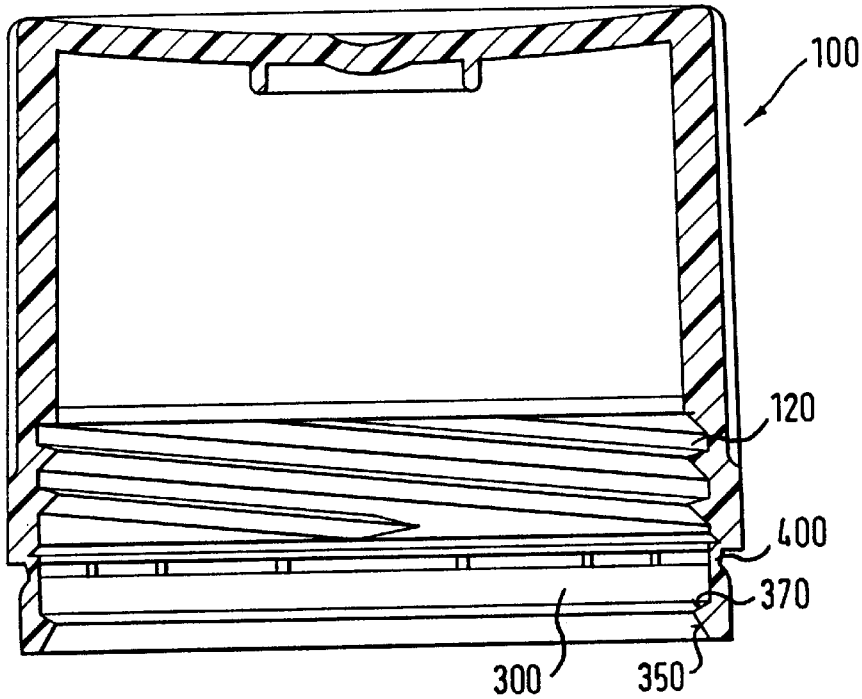
FIG. 4A shows a sectional view of a further preferred embodiment of the tube cap according to the invention and having a sealing strip according to the invention.
Figure 4B:
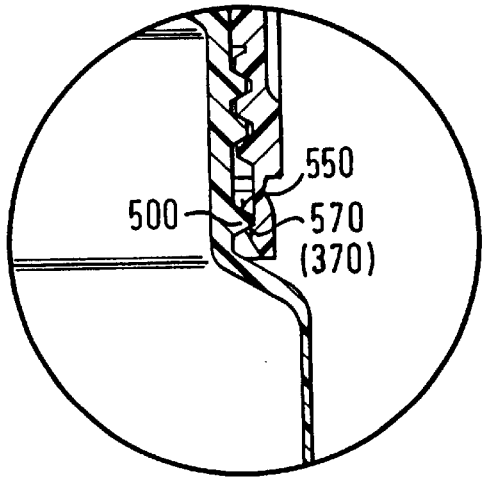
FIG. 4B shows a detailed view of the tube cap with sealing strip, the tube cap being screwed onto a tube body according to the invention.
Figure 4C:
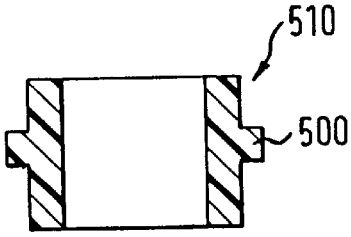
FIG. 4C shows a separate retrofitting part for a previously known tube which has the bulge according to the invention, which cooperates with a cap according to the invention and having a sealing strip.

FIGS. 4A, 4B and 4C show the second aspect of the plastic tube according to the invention, specifically a tube with a sealing strip.

The preferred embodiment of a tube cap 100 as represented is provided with a thread 120, and has in the lower region a sealing strip 300 which is connected by a number of webs 400 to the tube cap. When the tube cap 100 is being screwed onto the tube body, the sealing strip 300 is pressed over the screw thread of the tube body until finally, with a locking surface 350 which is formed on the lower side of the sealing strip 300 and runs circumferentially around the sealing strip in a circular fashion, it slips away over an annular bead 500 (compare FIG. 4B) constructed on the tube shoulder and latches below the annular bead 500. After latching in, the sealing strip 300 is held axially by a holding surface 370 (compare FIG. 4B).

FIG. 4B shows the annular bead 500 with the two surfaces 550 and 570, the surface 370 of the sealing strip 300 being shown latched on the surface 570. Another embodiment is possible also for the surface 570, which is represented inclined slightly upwards, such as, for example, a horizontal surface orientation or a surface orientation pointing downwards.

The inclination of the surfaces 570 or 370 is decisive for the later retention and resistance offered by the sealing strip 300 to screwing off the tube cap, and so it is to be considered in the dimensioning.

Screwing off the tube cap 100 for the first time introduces a torque into the tube cap, with the result that the tube cap moves upwards on the threads. This upward movement introduces a tensile stress into the webs 400 between the sealing strip 300 and tube cap 100. The thickness and number of the webs 400 is thus to be dimensioned in accordance with the torque to be applied in such a way that it is possible to ensure the webs 400 are torn.

Furthermore, the webs may not be of too strong a design, since otherwise they cannot be severed by the torque to be applied and the tensile stress associated therewith, and the sealing strip 300 would be withdrawn upwards over the annular bead 500.

FIG. 4C shows a particular variant of the inventive sealing strip arrangement, for which protection is desired in particular. A representation is given of a retrofitting part 510 which can be drawn in a self-closed fashion over a standard tube shoulder (not represented) which does not have an annular bead 500 required for latching with a sealing strip cap. It would thereby be possible for any tube to be fitted subsequently with the inventive sealing strip function with the aid of two small parts (for example the sealing strip cap represented in FIG. 4A and the retrofitting part of complementary design represented in FIG. 4C).

Figure 5:
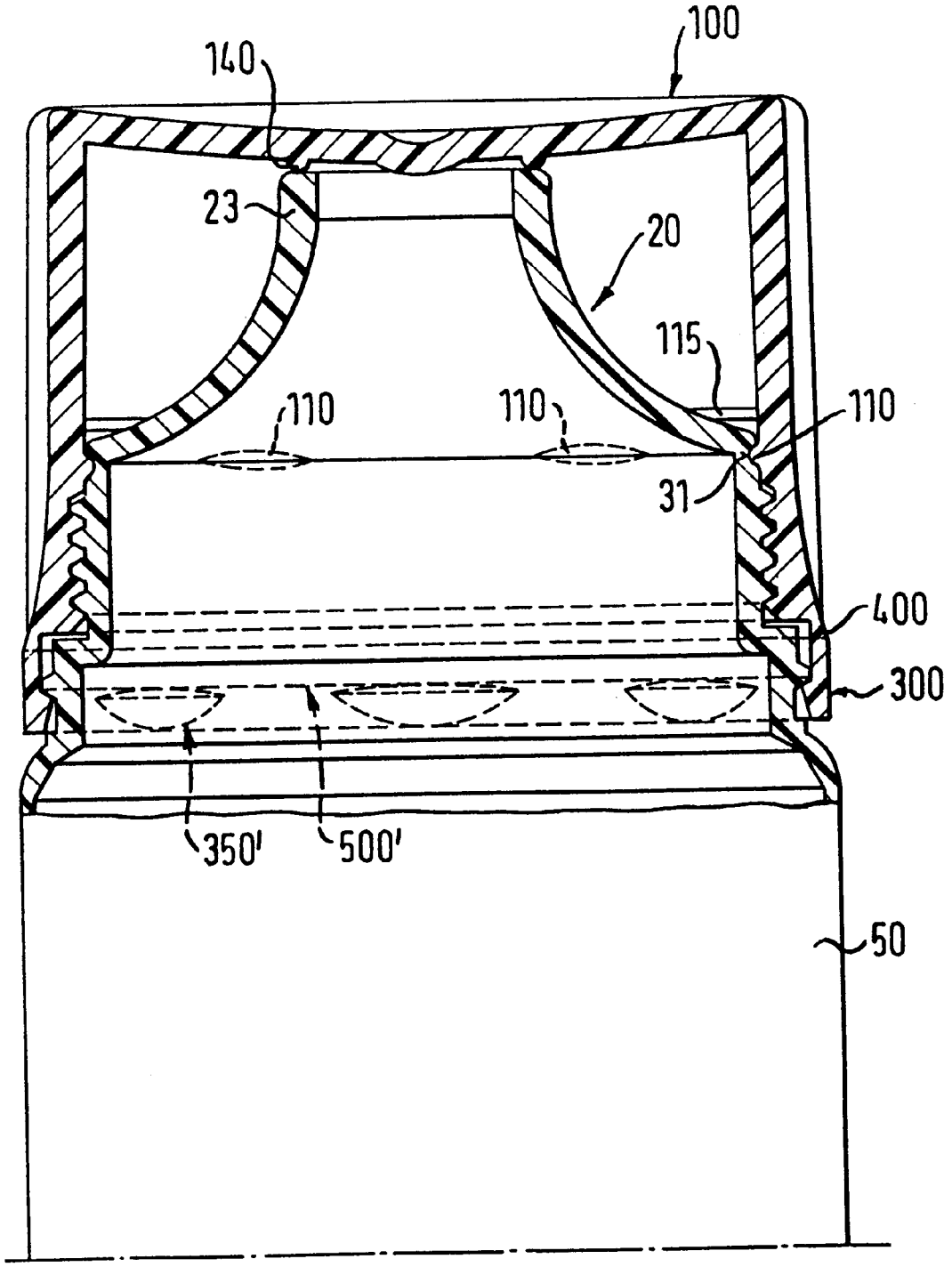
FIG. 5 shows a further embodiment of a tube according to the invention, which ha. both a sealing strip according to the invention and a tube locking mechanism according to the invention.

FIG. 5 shows a further, particularly preferred embodiment of an inventive plastic tube with a sealing strip. In this embodiment, instead of a locking surface 350 running round in the shape of a circle, the sealing strip has locking cams 350' These locking cams 350' slip away over a corresponding annular bead 500' constructed on the tube shoulder 20 and latch there. In accordance with a further preferred embodiment, it is also possible both to fit the tube cap with a circumferential locking surface 350, and to support the latter by means of additional locking cams 350'. This permits particularly reliable latching of the sealing strip. The annular bead 500' can otherwise be constructed as is the annular bead 500 from FIG. 4B, and the tube cap can be constructed as the one shown in FIG. 3.

Figure 6B:
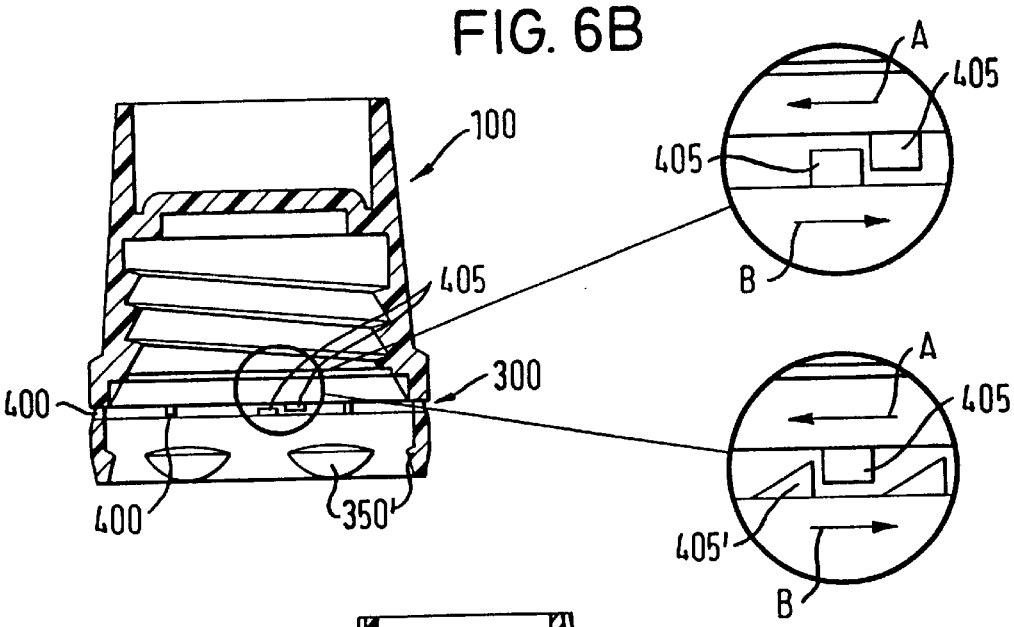
Figure 6C:
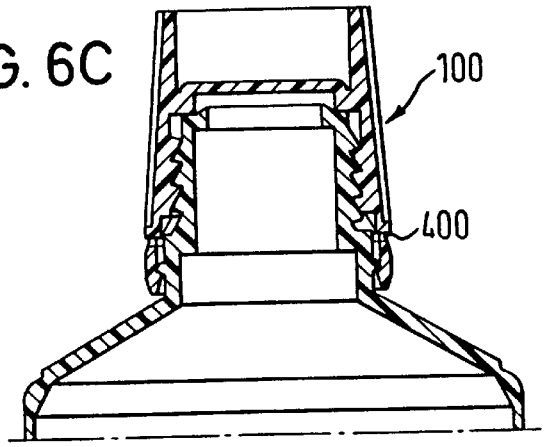

FIGS. 6A, 6B, 6C show an alternative, inventive tube as is used, in particular, in the USA. In addition to the smaller construction of the tube cap produced as a laminate cap, FIGS. 6A–6C, however, show two further, particularly preferred features of the tube according to the invention. Firstly, it may be gathered from FIG. 6A and, in particular, from the detailed view here that a bulge 500" with a fin-like shape is used here instead of an annular bead 500. This bulge 500" has-a surface 501 which cooperates with the sealing strip 300 and opposes the sealing strip with only a very slight resistance when screwing on is done for the first time, which permits the sealing strip to be applied easily. However, when separation is done for the first time, the bulge exerts a barb-like resistance against the locking cams 350' or the sealing strip (compare 6B), which leads to separation of the sealing strip (300) and tube cap (100).

The further feature, essential to the invention, is to be gathered from FIG. 6G and, in particular, from the detailed views here. The representation is given of driving elements 405 which are integrally formed both on the sealing strip 300 and on the tube cap 100. These driving elements 405 are mutually arranged in such a way that and cooperate such that when the tube cap 100 is screwed for the first time onto the tube shoulder 20 (direction of rotation A), the webs 400 are relieved of the shear forces occurring by the driving elements 405, and when the tube cap 100 is separated for the first time from the tube shoulder 20 (direction of rotation B), the shear forces act fully on the webs 400 and rupture them.

In accordance with a particularly preferred embodiment of the driving elements 405' on the sealing strip 300 (or on the tube cap 100), the latter have a run-up slope which, even given a smaller spacing of the driving elements 405, 405' on in each case the tube cap and the sealing strip 300, ensures that when the tube cap 100 is separated for the first time from the tube shoulder 20 (direction of rotation B) the driving elements 405, 405' do not catch on one another but repel one another and lead to rupture of the webs 400.

FIG. 7 shows a perspective representation of the sealing strip 300 with the torn-off webs 400, the preferred driving elements 405' and the sealing strip locking surface 350. The number of webs 400, and also the shape cuts and cross-sections (see the following FIGS. 8, 9) can be selected depending on the choice of material and/or aesthetic points of view, but according to the invention the number of webs should be at least two and they should be dimensioned such that a visible perforation can be detected. The dimensioning is to be selected in conjunction with the lead in accordance with the characteristic tensile strength of the respective material and a torque which is to be applied by hand.

As regards safety aspects, it is possible to select favourable dimensioning of the webs precisely for medical or pharmaceutical active substances which are contained in tubes and are to be protected from misuse by children, such that only an adult is able to detach the webs from the sealing strip or from the tube cap by applying a substantially higher torque.

FIG. 8 shows different embodiments of the invention as regards the webs 400 (400*a*, 400*b*, 400*c*). 400*a* is a web which is essentially constructed as a rectangle, it being impossible to determine the tear-off surface uniquely.

The web 400*b* is likewise perpendicular and also essentially has a rectangular cross-section, but a notch 450 which is arranged on the upper edge of the sealing strip or on the lower end of the web 400*b* provides a rupture point at which the webs 400*b* are to be detached from the ring 300.

The web 400*c* is arranged offset at an angle $\alpha$ with respect to the horizontal, as a result of which the tube cap 300 can be screwed very easily onto the tube body, and when the tube cap is being screwed off a lateral expansion of the web 400*c* introduces a notch effect into the sealing strip 300 in the opening region of the web 400*c*, with the result that the webs 400*c* can easily be torn off.

The sealing strip 300 is also shown in lateral section with the surfaces 350 and 370 and the lower edge 352, the dimensioning of the webs 400 being represented only by way of example—although also preferred. Also to be gathered from the lateral sectional view is an additional embodiment (represented by dashes) in accordance with which the surface 370 can be constructed as an undercut. This embodiment also ensures particularly secure latching of the sealing strip.

The rotational orientation of the tube cap is determined by the choice of thread. As represented in FIG. 3, the right-hand threads can be screwed onto the thread in the direction A and detached from the thread in the direction B. The direction of rotation is reversed in the case of left-hand threads.

FIG. 9 shows two embodiments 352*a,b* of the lower edge 352. These embodiments are provided with a sawtoothed contour. The advantage of the sawtoothed contour resides in the action of the sealing strip to inhibit rotation with respect to the direction of rotation B, the flanks 390 stopping the sealing strip from rotating, that is to say producing increased slippage. The embodiment 352*a* has a vertical flank 390*a*, whereas the embodiment 352*b* has a flank 390*b* inclined with respect to the perpendicular. By contrast with the vertical flank 390, the inclined flank 390*b* has the advantage that greater security against rotation is ensured and, at the same time, security against axial displacement can be achieved, since owing to the tilting of the undercut a higher resistance is brought into opposition. The contours 390*a,b* engage in a complementary tooth system arranged on the tube body.

Finally, FIG. 10 shows a further, preferred plastic tube, in which the screw thread of the cap 100 is integrally formed on the cap base 110. This tube too can optionally have the locking mechanism according to the invention and the inventive sealing strip (an embodiment only with the sealing strip is represented).

It may be remarked that the exemplary embodiments described above represent merely preferred embodiments of the present invention without the intention to limit the extent of protection.

What is claimed is:

1. A plastic tube for flowable, free-flowing or pasty components, comprising:

a. a main tube body and a tube shoulder, which adjoins the main tube body and has a bulge;

b. a tube cap which, for the purpose of sealing said main tube body, cooperates with said tube shoulder, and along whose lower edge a sealing strip extends which can be separably connected to the tube cap in such a way that when the tube cap is separated in a removal direction for the first time from the tube shoulder said strip is detached from the tube cap and remains connected to the main tube body; and c. wherein the bulge is of fin-like construction in order to facilitate screwing on the tube cap for the first time, and wherein the bulge has an inclined underside forming a barb edge projecting in a direction opposite the removal direction of the tube cap to oppose the sealing strip with a barb-like resistance when the tube is opened for the first time.

2. The plastic tube according to claim 1, the perforation-like webs extending essentially parallel to the tube axis.

3. The plastic tube according to claim 1, the perforation-like webs being arranged at an angle with respect to the tube axis.

4. The plastic tube according to claim 1, the perforation-like webs having a notch-like cutout in the opening region of web and sealing strip.

5. The plastic tube according to claim 1, the sealing strip being connected to the tube cap in a perforated fashion by webs.

6. The plastic tube according to claim 5, in which the sealing strip and the lower cap edge of the tube cap each have integrally formed therewith at least one driving element, the driving elements on the sealing strip and the tube cap being mutually arranged and cooperable in such a way that when the tube cap is screwed on to the tube shoulder for the first time the driving elements interact to transfer shear forces between the cap and sealing strip independently of the webs, and when the tube cap is separated for the first time from the tube shoulder the driving elements are relatively movable to allow shear forces to act on the webs and rupture them.

7. The plastic tube according to claim, in which the driving element on either the tube cap or the sealing strip has a run up slope which enables the driving elements to pass one another to ensure that when the tube cap is separated for the first time from the tuve shoulder (20) the shear forces act fully on the webs an rupture them.

8. The plastic tube according to claim 1, the lower edge of the sealing strip having a downwardly directed saw-toothed contour.

9. The plastic tube according to claim 8, the sawtoothed contour engaging in a complementary contour on the surface of the tube body.

10. The plastic tube according to claim 9, the sawtoothed contour acting to inhibit rotation for the sealing strip when the tube cap is turned to be opened.

* * * * *